US007472516B2

(12) United States Patent
Pepper et al.

(10) Patent No.: US 7,472,516 B2
(45) Date of Patent: Jan. 6, 2009

(54) ADJUSTABLE THRESHOLD ASSEMBLY

(75) Inventors: Michael E. Pepper, Richmond, IN (US); James W. Meeks, Enton, OH (US)

(73) Assignee: Quanex Corporation, Houston, TX (US)

( * ) Notice: Subject to any disclaimer, the term of this patent is extended or adjusted under 35 U.S.C. 154(b) by 514 days.

(21) Appl. No.: 11/183,510

(22) Filed: Jul. 18, 2005

(65) Prior Publication Data

US 2006/0112644 A1 Jun. 1, 2006

Related U.S. Application Data

(60) Provisional application No. 60/632,169, filed on Dec. 1, 2004.

(51) Int. Cl.
*E06B 1/70* (2006.01)

(52) U.S. Cl. ..... 49/468; 49/467; 49/470

(58) Field of Classification Search ..... 49/467, 49/468, 469; 52/204.1; 411/84, 104, 180, 411/427

See application file for complete search history.

(56) References Cited

U.S. PATENT DOCUMENTS

| | | | | |
|---|---|---|---|---|
| 3,119,430 | A * | 1/1964 | Di Rico | 411/247 |
| 4,352,258 | A | 10/1982 | Bursk et al. | |
| 5,179,804 | A | 1/1993 | Young | |
| 5,230,181 | A | 7/1993 | Geoffrey et al. | |
| D354,572 | S | 1/1995 | Headrick | |
| 5,426,894 | A | 6/1995 | Headrick | |
| 5,517,788 | A * | 5/1996 | McGough et al. | 49/468 |
| 5,524,391 | A | 6/1996 | Joffe et al. | |
| 5,588,266 | A | 12/1996 | Headrick | |
| 5,611,173 | A | 3/1997 | Headrick et al. | |
| 5,638,641 | A | 6/1997 | Joffe et al. | |
| 6,345,477 | B1 | 2/2002 | Kepler et al. | |
| 2002/0129557 | A1 | 9/2002 | Young | |
| 2002/0194787 | A1 | 12/2002 | Bennett | |
| 2004/0139667 | A1 | 7/2004 | Massey et al. | |
| 2004/0200152 | A1 * | 10/2004 | Khanlarian | 49/468 |
| 2004/0200153 | A1 | 10/2004 | Khanlarian | |

OTHER PUBLICATIONS

U.S. Appl. No. 10/800,317, filed Mar. 3, 2004, Ferrell.

* cited by examiner

*Primary Examiner*—Katherine W Mitchell
*Assistant Examiner*—Michael J Keller
(74) *Attorney, Agent, or Firm*—Howard & Howard Attorneys, P.C.

(57) ABSTRACT

A threshold assembly includes a base defining a channel, a plurality of nuts slideably engaged in the channel, a rail disposed on the base and defining a plurality of holes, and a plurality of threaded fasteners rotationally retained in the holes and threadedly engaging the nuts. The channel has a neck and a pair of opposing sides angling outwardly from the neck into the base. Each nut presents opposing contact surfaces complimentary to the opposing sides of the channel such that the nut is slideably engaged in the channel. The nut also includes an elongated platform such that when the threaded fastener is rotated, the elongated platform and the opposing contact surfaces of the nut engage the opposing sides of the channel such that the height of the rail relative to the base is adjusted in response to rotation of the threaded fastener relative to the nut.

19 Claims, 3 Drawing Sheets

ADJUSTABLE THRESHOLD ASSEMBLY

CROSS REFERENCE TO RELATED APPLICATION

This application claims the benefit of provisional application Ser. No. 60/632,169 filed Dec. 1, 2004, the advantages and disclosure of which are hereby incorporated by reference.

BACKGROUND OF THE INVENTION

1. Field of the Invention

The present invention relates to an adjustable threshold assembly for disposition below a door assembly.

2. Description of the Related Art

Various adjustable threshold assemblies are known in the prior art and typically include a sill, a base, and a rail. The threshold assembly is disposed below a door assembly. The door assembly typically includes a hinged door and the rail is disposed on the base below the hinged door. The height of the rail may be adjusted relative to the base to create a water-tight, air-tight, and debris-tight seal between the rail and a bottom edge of the door. In other words, instead of varying the height of the door to accommodate the threshold, the height of the threshold is varied to accommodate the height of the bottom edge of the door.

Traditionally, the sill includes a rail bar disposed on the base below the rail. Holes are defined by the rail bar to align with holes defined by the base. Holes defined by the rail are in alignment with the holes in the base and the holes in the rail bar. Threaded fasteners are rotationally retained in the holes in the rail and extend through the holes in the rail bar and threadedly engage the holes in the base. The height of the rail relative to the base may be adjusted by turning the threaded fasteners. The rail bar on the sill makes the sill "handed," or in other words a unique sill must be created for differing door assemblies. For example, in a door assembly having the hinged door to the left of a fixed panel, the rail and the rail bar must be disposed on a left side of the base below the hinged door. Alternatively, a door assembly having the hinged door to the right of the fixed panel requires that the rail and the rail bar be disposed on a right side of the base below the hinged door. The requirement to manufacture the unique sill for differing door assemblies is cumbersome.

U.S. Pat. No. 5,517,788 to McGough et al discloses a threshold assembly including a non-handed sill that does not include a rail bar. McGough discloses a base defining a channel, a rail disposed on the base and defining holes spaced along the rail, nuts pressed into the channel, and screws extending though the holes in the rail to threadedly engage the nut to attach the rail to the base. The elimination of the rail bar makes the sill non-handed so that the sill may be used in the threshold assembly regardless of whether the hinged door is to the right or to the left of the fixed panel. However, the McGough patent uses nuts that do not slide within the channel which thereby creates difficulties if the rail must be moved to a different portion of the base for disposition below the hinged door.

U.S. Patent Application Publication 2004/0200152 to Khanlarian discloses t-shaped nuts that are slideably engaged in a t-shaped channel in a base. Threaded fasteners are retained by the rail and threadedly engage the t-shaped nuts. The t-shaped nut includes a platform and a shaft extending upwardly from the platform. The t-shape nuts may be slid along the channel such that the rail may be slid to any position along the channel for disposition below a hinged door. When a person steps on the rail, a load is exerted on the nut. Traditionally, the t-shaped nut is made of a strong material such as metal to withstand force exerted on the nut to prevent fracture of the platform or the shaft, especially at the intersection of the platform and the shaft. In other words, the t-shape of the nuts and the channel limits the type of material the nut can be made of to a strong material such as metal such that the material is strong and durable to withstand the force exerted on the nut. The metal nuts may rust or corrode over time thereby creating difficulty in adjusting the height of the rail relative to the base.

It is desirable to manufacture a nut that is shaped such that the nut may be formed from a wide range of materials and yet be durable and strong enough to withstand forces exerted on the nut. More specifically, it is desirable to manufacture a strong and durable nut that is shaped such that the nut may be made from an increased range of materials such as a resin component.

SUMMARY OF THE INVENTION AND ADVANTAGES

The present invention is an adjustable threshold assembly comprising a base extending along an axis. The base presents an upper surface with a channel extending into the upper surface and longitudinally along the axis. A rail is disposed longitudinally along the base above the channel. The rail defines a hole and a threaded fastener is retained in the hole and extends downwardly into the channel. The threshold assembly is characterized by the channel having a neck at the upper surface and a pair of opposing sides angling outwardly from the neck into the base and a nut having a bore engaging the threaded fastener and presenting opposing contact surfaces complementary to the pair of opposing sides for slideably engaging the pair of opposing sides.

Accordingly, force applied to the nut is distributed along the opposing contact surfaces of the nut and the opposing sides of the channel. The shape of the nut, with the opposing contact surfaces, causes the force to be distributed along the opposing contact surfaces of the nut thereby increasing the strength and durability of the nut. Because the shape of the nut makes the nut stronger and more durable, the nut may be formed from an increased range of materials including resin components.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
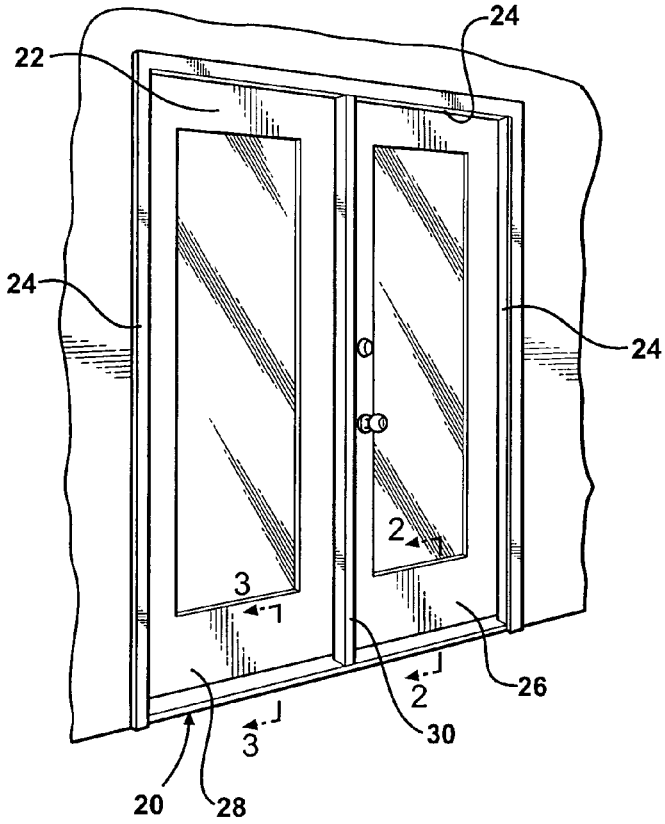
FIG. 1 is a perspective view of a threshold assembly disposed below a door assembly.

The present invention is an adjustable threshold assembly as shown generally at 20. As shown in FIG. 1, the threshold assembly 20 is mounted below a door assembly 22 of a building such as a commercial or residential building. The door assembly 22 includes a frame 24, a hinged door 26 mounted to the frame 24, a fixed panel 28 mounted to the frame 24 opposite the hinged door 26, and a mullion 30 disposed between the hinged door 26 and the fixed panel 28.

The threshold assembly 20 includes a base 32 extending along an axis. The base 32 includes a first portion 34 for disposition below the hinged door 26 and a second portion 36 in longitudinal alignment with the first portion 34 along the base 32 for disposition below the fixed panel 28. It should be appreciated that the threshold assembly 20 shown in FIG. 1 is disposed below the door assembly 22 including the fixed panel 28 and the hinged door 26, however, the threshold assembly 20 is not limited to such a door assembly 22 but may also be disposed below a door assembly 22 including any combination or multiple of hinged doors 26 and fixed panels 28. By way of example, the threshold assembly 20 may be disposed below, among others, a door assembly 22 including a fixed panel 28 on either side of a hinged door 26, a door assembly 22 including an astragal disposed between a moveable hinged door and a semi-moveable hinged door, or a door assembly 22 including one hinged door 26. It should also be appreciated that the threshold assembly 20 shown in FIGS. 1-2 is disposed below a door assembly 22, however the threshold assembly 20 is not limited to being disposed below a door assembly 22, but, by way of example, may be disposed above a door assembly 22.

Figure 6:
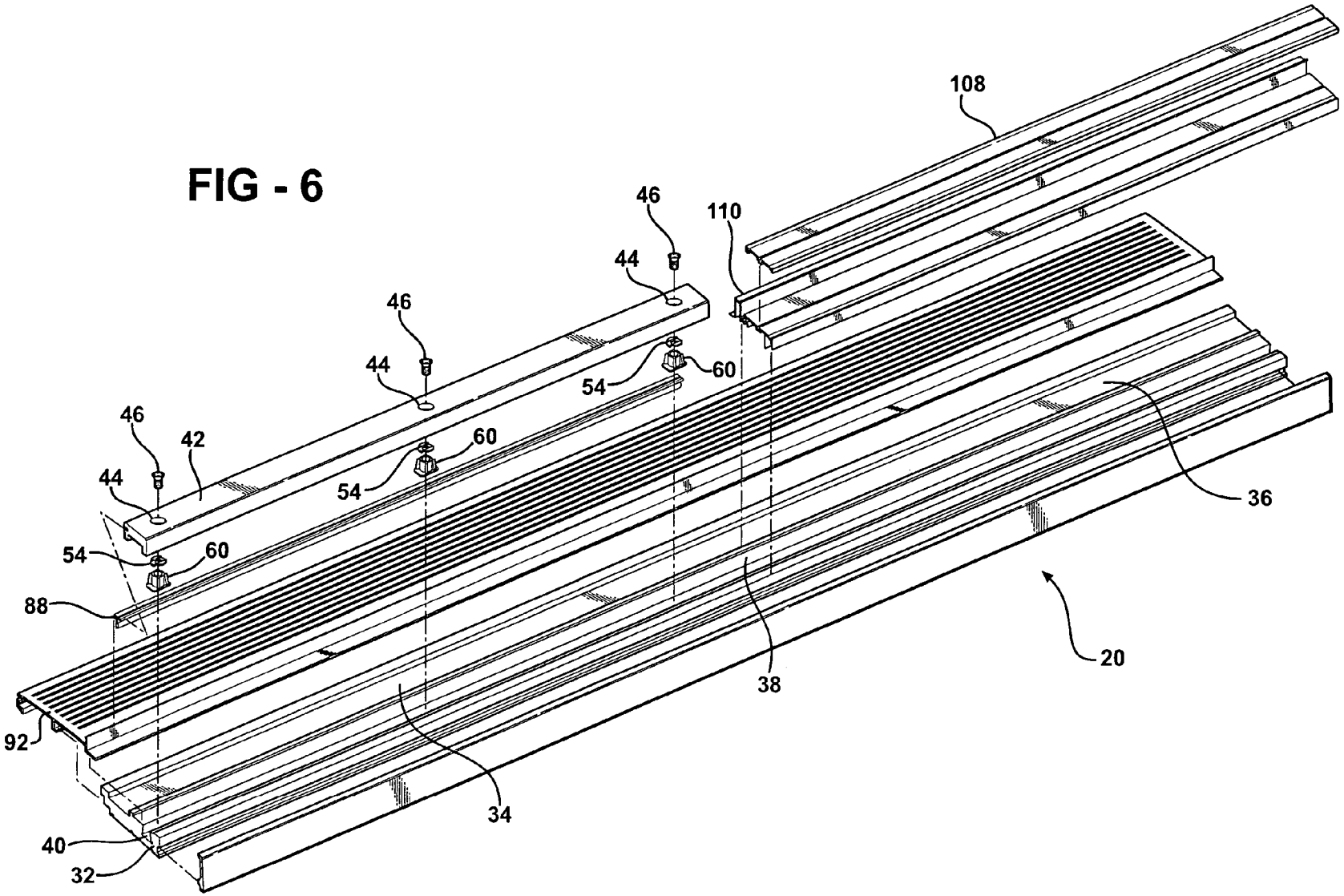
FIG. 6 is an exploded view of the threshold assembly shown in FIGS. 1, 2, and 3.

As seen in FIG. 6, the base 32 presents an upper surface 38 and a channel 40 extends into the upper surface 38 and longitudinally along the axis. A rail 42 is disposed longitudinally along the base 32 above the channel 40. The rail 42 defines a hole 44 and a threaded fastener 46 is retained in the hole 44 and extends downwardly into the channel 40. More specifically, the assembly 20 includes a plurality of the holes 44 spaced longitudinally along the rail 42 and a plurality of the threaded fasteners 46 with each of the threaded fasteners 46 retained in one of the holes 44. Each threaded fastener 46 includes a head 48 and a shaft. The shaft includes a smooth portion 50 extending from the head 48 and a threaded portion 52 extending from the smooth portion 50. The rail 42 is counter-bored around each hole 44. The head 48 engages the counter-bored hole 44 and the shaft extends through the hole 44 such that the smooth portion 50 partially extends from the hole 44 and the threaded portion 52 is completely exposed. The assembly 20 also includes a plurality of retainers 54 with each of the retainers 54 engaging one of the threaded fasteners 46 for retaining the threaded fasteners 46 in the holes 44. More specifically, the retainer 54 includes an aperture, which is sized relative to the smooth portion 50 of the shaft such that the retainer 54 is press fit onto the smooth portion 50 of the shaft. The retainer 54 does not rotate relative to the threaded fastener 46 and the head 48 and smooth portion 50 of the threaded fastener 46 may rotate relative to the hole 44 thereby rotationally retaining the threaded fastener 46 in the hole 44.

Figure 2:
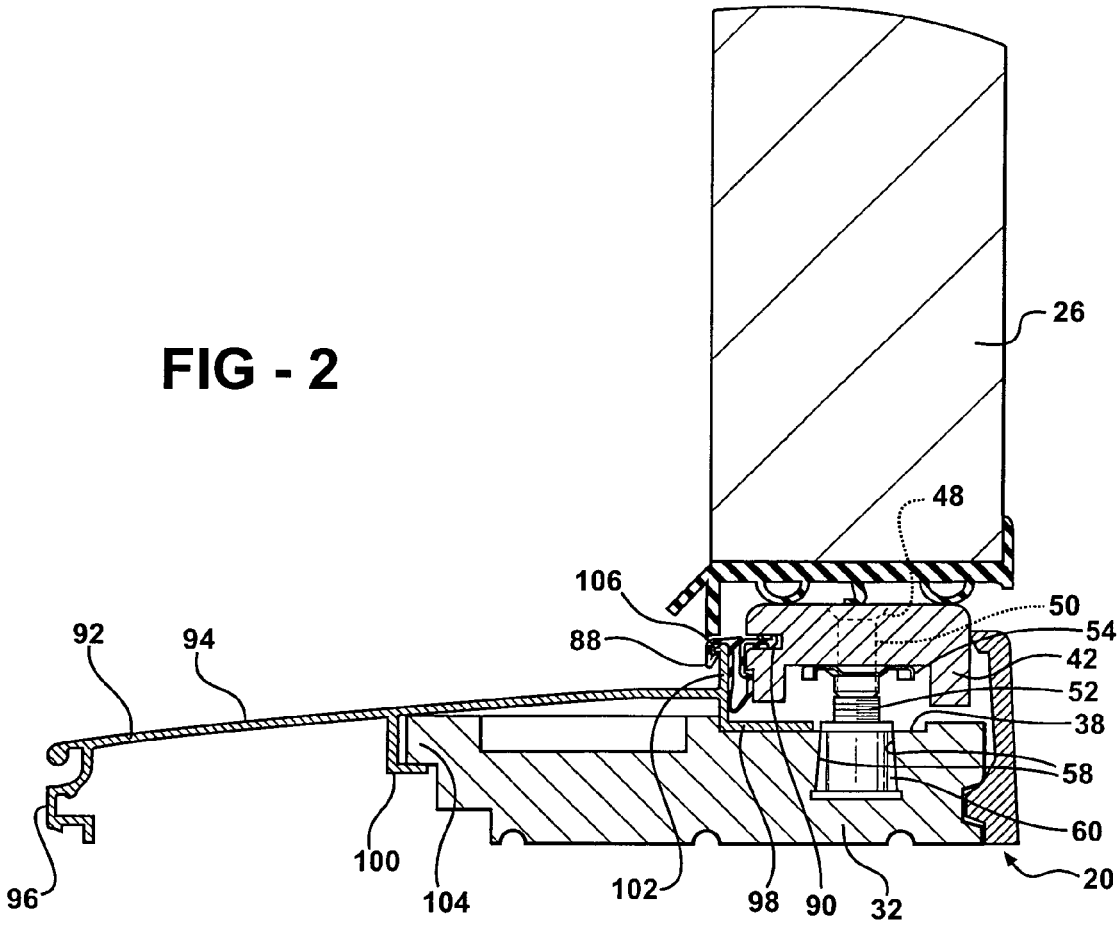
FIG. 2 is a cross-sectional view of a first portion of the threshold assembly taken along line 2-2 of FIG. 1.

As seen in FIG. 2, the assembly 20 is characterized by the channel 40 having a neck 56 at the upper surface 38 and a pair of opposing sides 58 angling outwardly from the neck 56 into the base 32 and a nut 60 having a bore 62 engaging the threaded fastener 46 and presenting opposing contact surfaces 64 complementary to the pair of opposing sides 58 for slideably engaging the pair of opposing sides 58. More specifically, the assembly 20 includes a plurality of the nuts 60 with each of the nuts 60 engaging one of the threaded fasteners 46 along a center axis. Preferably, the opposing sides 58 of the channel 40 angle outwardly from the neck 56 at approximately a 5° angle relative to the center axis. The opposing contact surfaces 64 of the nuts 60 slideably engage the opposing sides 58 of the channel 40 and the space between the opposing contact surfaces 64 and the opposing sides 58 of the channel 40 is preferably 0.01 inch. The opposing contact surfaces 64 slideably engage the opposing sides 58 of the channel 40 to prevent the nut 60 from rocking in the channel 40 and thereby preventing the rail 42 from rocking relative to the base 32 when, for example, a person steps on the rail 42.

Figure 4:
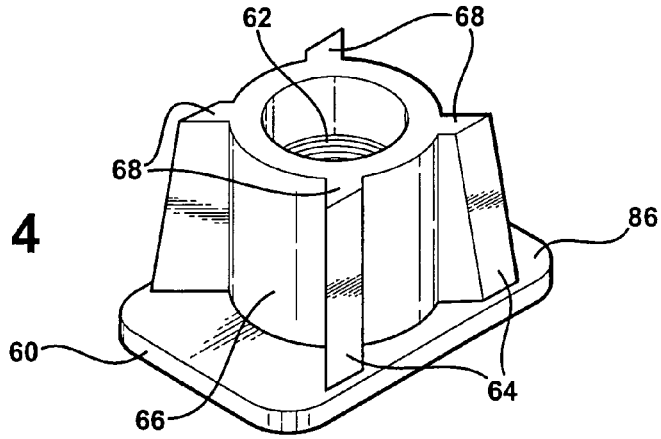
FIG. 4 is a perspective view of a nut.

As shown in FIG. 2 and FIG. 4, the opposing contact surfaces 64 of the nut 60 are further defined as being planar and parallel to the opposing sides 58 of the channel 40. The nut 60 includes a central pillar 66 and a plurality of flanges 68 extending radially from the central pillar 66 to present the contact surfaces 64. The bore 62 extends into the central pillar 66. The bore 62 is threaded such that the threaded portion 52 of the threaded fastener 46 is threadedly engaged with the bore 62.

The opposing sides 58 of the channel 40 include a first side 70 and a second side 72 opposing the first side 70. The flanges 68 on the nut 60 include a first flange 74, a second flange 76, a third flange 78, and a fourth flange 80. The first flange 74 and the second flange 76 present the contact surfaces 64 parallel to the first side 70 of the channel 40. The third flange 78 and a fourth flange 80 present the contact surfaces 64 parallel to the second side 72 of the channel 40.

Figure 5:
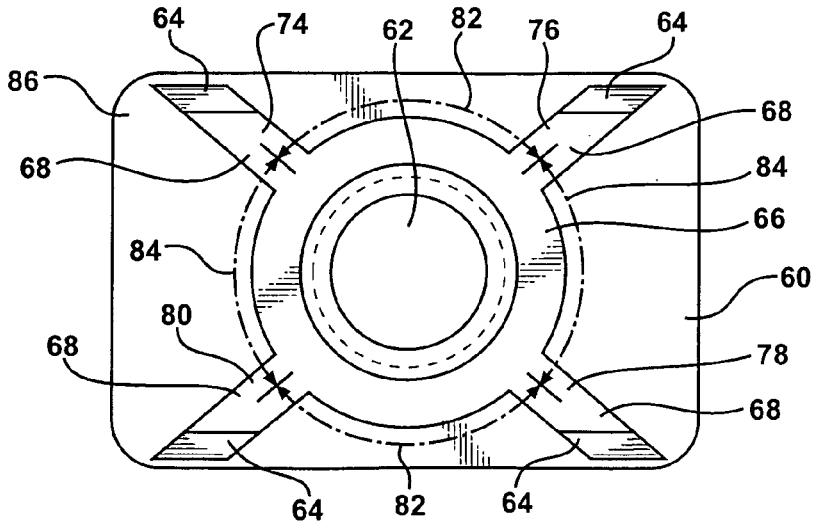
FIG. 5 is a top view of the nut.

As seen in FIG. 5, the first flange 74 extends at a side angle 82 relative to the second flange 76 and the third flange 78 extends at the side angle 82 relative to the fourth flange 80. The first flange 74 extends at an end angle 84 relative to the fourth flange 80 and the second flange 76 extends at the end angle 84 relative to the third flange 78. In other words, the side angle 82 between the first flange 74 and the second flange 76 is equivalent to the side angle 82 between the third flange 78 and the fourth flange 80. Likewise, the end angle 84 between the first flange 74 and the fourth flange 80 is equivalent to the end angle 84 between the second flange 76 and the third flange 78. The side angle 82 is greater than the end angle 84 and the side angle 82 and the end angle 84 are supplementary. Preferably, the side angle is 100° and the end angle is 80°. The central pillar 66 is further defined as being round and the first flange 74, the second flange 76, the third flange 78, and the fourth flange 80 extend radially at an equal length from the central pillar 66. In other words, the flanges 68 extend from the central pillar 66 to define an x-shaped pattern, as seen in FIG. 5.

As seen in FIGS. 2, 4, and 5, the nut 60 includes an elongated platform 86 slideably engaging the channel 40 for limiting rotation of the nut 60 in the channel 40. The pillar 66 and the flanges 68 are integral with and extend upwardly from the elongated platform 86. The height of the rail 42 relative to the base 32 is adjusted in response to rotation of the threaded fastener 46 in the bore 62 in the pillar 66 and the elongated platform 86 limits rotation of the nut 60.

The height of the rail 42 relative to the base 32 may be adjusted to form a seal between the rail 42 and a bottom edge of the door. If the rail 42 is too low relative to the hinged door 26 then an unwanted space is created between the rail 42 and the bottom edge of the hinged door 26 thereby creating the potential for rain, draft, and dirt to enter the building between the unwanted space. To the contrary, if the rail 42 is too high relative to the bottom edge of the hinged door 26 then excessive force is required to close the hinged door 26 over the rail 42. The ability to adjust the height of the rail 42 relative to the base 32 enables the height of the rail 42 to be adjusted relative to the bottom edge of the hinged door 26 to achieve the proper seal between the rail 42 and the hinged door 26.

Preferably, the head 48 of the threaded fastener 46 is of the type that may be rotated with a standard tool such as a screwdriver. As the threaded fastener 46 is rotated, the elongated platform 86 engages the opposing sides 58 of the channel 40 to prevent rotation of the nut 60 within the channel 40. When the threaded fastener 46 is rotated clockwise, the opposing contact surfaces 64 of the nut 60 and the elongated platform 86 engage the opposing sides 58 of the channel 40 and the head 48 of the threaded fastener 46 is lowered relative to the nut 60 thereby lowering the height of the rail 42 relative to the base 32. When the threaded fastener 46 is rotated counter-clockwise, the threaded fastener 46 is raised relative to the nut 60 thereby raising the height of the rail 42 relative to the base 32.

Contact between the elongated platform 86 and the opposing sides 58 of the channel 40 and contact between the contact surfaces 64 of the nut 60 and the opposing sides 58 of the channel 40 prevents rocking of the rail 42 when a person steps on the rail 42. In addition, the elongated platform 86 of the nut 60 distributes weight applied to the nut 60 along a larger area of a bottom of the channel 40 thereby preventing rocking of the rail 42 relative to the base 32. By way of example, when a person steps on the rail 42, the weight is transferred through the nut 60 and the elongated platform 86 distributes the weight across the larger area of the bottom of the channel 40.

Preferably, the nut 60 is formed from a resin component and the base 32 is formed from a composite. More, preferably, the nut 60 is formed from ABS plastic. Alternatively, the nut 60 may be formed from a polymer commercially available from DuPont under the trade name Delrin®. The composite is more preferably formed from a composite lumber. The composite lumber is preferably a material formed from a combination of a binder and a filler, such as polyethylene and wood, respectively. However, it should be appreciated that the resin component is not limited to ABS plastic or Delrin® and the composite is not limited to a composite lumber. To this end, any materials may be used so long as a low friction interaction exists between the nuts 60 and the channel 40 of the base 32. This low friction interaction allows the nuts 60 to easily slide within the channel 40 of the base 32.

The flanges 68 of the nut 60 provide structural rigidity to the nuts 60 such that the nuts 60 may withstand forces applied to the nut 60 when, for example, a person steps on the rail 42. In addition, the shape of the nut 60, with the opposing contact surfaces 64, causes the force applied to the nut 60 to be distributed along the opposing contact surfaces 64 of the nut 60 thereby increasing the strength and durability of the nut 60.

As seen in FIG. 6, the rail 42 defines a groove 90 extending longitudinally along the base 32. A sill 92 is attached to the base 32. The sill 92 is preferably made of aluminum and includes a sloping top wall 94 that extends to a toe 96, a downwardly extending L-shaped portion 98, and a finger 100 extending from an underside of the sloping top wall 94. The sill 92 also presents a vertical extension 102 extending longitudinally along the base 32. The L-shaped portion 98 is disposed on the upper surface 38 of the base 32 and the finger 100 wraps around a lip 104 on the base 32. The L-shaped portion 98 is stapled to the upper surface 38 of the base 32. The vertical extension 102 includes a protrusion 106 extending longitudinally along the vertical extension 102. A seal 88 is pressed into the groove 90 on the rail 42 and is snapped over the vertical extension 102 on the sill 92 for maintaining a water-proof seal 88 between the rail 42 and the sill 92. The seal 88 engages the protrusion 106 on the vertical extension 102 to engage the seal 88 to the vertical extension 102. The seal 88 is preferably of the type described in U.S. Pat. No. 5,230,181 to Geoffrey, which is hereby incorporated by reference.

Figure 3:
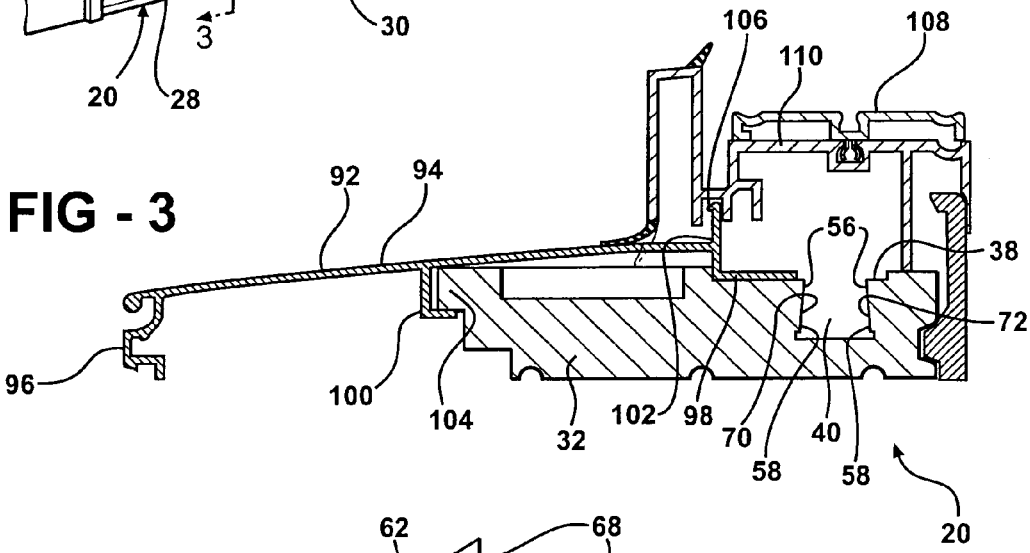
FIG. 3 is a cross-sectional view of a second portion of the threshold assembly taken along line 3-3 of FIG. 1.

The rail 42 is further defined as extending along the first portion 34 of the base 32 for disposition below the hinged door 26. As seen in FIG. 3 and FIG. 6, a cap 110 is attached to the vertical extension 102 of the sill 92 and disposed longitudinally along the second portion 36 of the base 32 for disposition below the fixed panel 28. The cap 110 provides a flat ledge 108 for supporting the fixed panel 28.

The threshold assembly 20 is non-handed, or in other words, the threshold assembly 20 may be disposed below a door assembly 22 regardless of whether the hinged door 26 is to the right or to the left of the fixed panel 28. Both the rail 42 and the cap 110 are disposed above the upper surface 38 of the base 32 and both the rail 42 and the cap 110 engage the same vertical extension 102 of the sill 92 that extends along the entire length of the sill 92. The rail 42 may be assembled to the base 32 below the hinged door 26 regardless of whether the hinged door 26 is to the right or to the left of the fixed panel 28.

The rail 42 and the cap 110 may also be interchanged along the base 32. By way of example, if the rail 42 is disposed on the base 32 to the left of the cap 110, but the threshold assembly 20 is to be mounted below a door assembly 22 including the hinged door 26 to the right of the fixed panel 28, the rail 42 and the cap 110 may be interchanged along the base 32 such that the rail 42 is disposed on the base 32 to the right of the cap 110. To interchange the cap 110 and the rail 42, the cap 110 is disengaged from the vertical extension 102 of the sill 92, the nuts 60 are slid along the channel 40 to move the rail 42 to the required position along the base 32 for disposition below the hinged door 26, and the cap 110 is engaged with the vertical extension 102 of the sill 92 at the required position of the cap 110 for disposition below the fixed panel 28.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. An adjustable threshold assembly comprising;

a base extending along an axis presenting an upper surface with a channel extending into said upper surface and longitudinally along said axis, a rail disposed longitudinally along said base above said channel and defining a hole, and a threaded fastener retained in said hole and extending downwardly into said channel, wherein said channel has a neck at said upper surface and a pair of opposing sides angling outwardly from said neck into said base and a nut having a bore engaging said threaded fastener and presenting opposing contact surfaces complementary to said pair of opposing sides for slideably engaging said pair of opposing sides, wherein said opposing contact surfaces of said nut are further defined as being planar and parallel to said opposing sides of said channel, wherein said nut includes a central pillar and a plurality of flanges extending radially from said central pillar to present said contact surfaces, said bore extending into said central pillar, wherein said opposing sides of said channel include a first side and a second side opposing said first side and said flanges on said nut include a first flange and a second flange presenting said contact surfaces parallel to said first side and a third flange and a fourth flange presenting said contact surfaces parallel to said second side, wherein said first flange extends at a side angle relative to said second flange and said third flange extends at said side angle relative to said fourth flange, wherein said first flange extends at an end angle relative to said fourth flange and said second flange extends at said end angle relative to said third flange, and wherein said side angle is greater than said end angle with said side angle and said end angle being supplementary.

2. An assembly as set forth in claim 1 wherein said central pillar is further defined as being round and said first flange and said second flange and said third flange and said fourth flange extend radially at an equal length from said central pillar.

3. An assembly as set forth in claim 1 wherein said nut includes an elongated platform slideably engaging said channel for limiting rotation of said nut in said channel, said pillar and said flanges integral with and extending upwardly from said platform whereby the height of said rail relative to said base is adjusted in response to rotation of said threaded fastener in said bore in said pillar and said elongated platform limits rotation of said nut.

4. An assembly as set forth in claim 1 wherein said nut is formed from a resin component and said base is formed from a composite.

5. An assembly as set forth in claim 1 including a plurality of said holes spaced longitudinally along said rail and a plurality of said threaded fasteners with each of said threaded fasteners retained in one of said holes.

6. An assembly as set forth in claim 5 including a plurality of retainers with each of said retainers engaging one of said threaded fasteners for retaining said threaded fasteners in said holes.

7. An assembly as set forth in claim 6 including a plurality of said nuts with each of said nuts engaging one of said threaded fasteners.

8. An assembly as set forth in claim 1 wherein said rail defines a groove extending longitudinally along said base.

9. An assembly as set forth in claim 8 including a sill attached to said base presenting a vertical extension extending longitudinally along said base and a seal pressed into said groove on said rail and snapped over said vertical extension on said sill for maintaining a water-proof seal between said rail and said sill.

10. An assembly as set forth in claim 9 wherein said base includes a first portion for disposition below a hinged door and a second portion in longitudinal alignment with said first portion along said base for disposition below a fixed panel.

11. An assembly as set forth in claim 10 wherein said rail is further defined as extending along said first portion of said base for disposition below the hinged door.

12. An assembly as set forth in claim 11 including a cap attached to said vertical extension of said sill and disposed longitudinally along said second portion of said base for disposition below the fixed panel.

13. An adjustable threshold assembly comprising;

a base extending along an axis presenting an upper surface with a channel extending into said upper surface and longitudinally along said axis, said channel having a neck at said upper surface and a pair of opposing sides angling outwardly from said neck into said base, a rail disposed longitudinally along said base above said channel and defining a plurality of holes spaced longitudinally along said rail, a plurality of threaded fasteners with each of said threaded fasteners retained in one of said holes and extending downwardly into said channel, a plurality of nuts slideably retained in said channel and each of said nuts including an elongated platform slideably engaging said channel for preventing rotation of said nuts relative to said channel and having a plurality of flanges defining planar surfaces complementary to said pair of opposing sides of said channel for slideably engaging said pair of opposing sides, and each of said nuts having a bore threadedly engaging one of said threaded fasteners for adjusting the height of said rail relative to said base in response to rotation of said threaded fasteners, wherein each of said nuts includes a central pillar and a plurality of flanges extending radially from said central pillar to present said planar surfaces, said bore extending into said central pillar, and wherein each of said nuts includes an elongated platform slideably engaging said channel for limiting rotation of said nut in said channel, said pillar and said flanges integral with and extending upwardly from said platform whereby the height of said rail relative to said base is adjusted in response to rotation of said threaded fastener in said bore in said pillar and said elongated platform limits rotation of said nut.

14. An adjustable threshold assembly comprising;

a base extending along an axis presenting an upper surface with a channel extending into said upper surface and longitudinally along said axis, a rail disposed longitudinally along said base above said channel and defining a hole, and a threaded fastener retained in said hole and extending downwardly into said channel, wherein said channel has a neck at said upper surface and a pair of opposing sides angling outwardly from said neck into said base and a nut having a bore engaging said threaded fastener and presenting opposing contact surfaces complementary to said pair of opposing sides for slideably engaging said pair of opposing sides, wherein said opposing contact surfaces of said nut are further defined as being planar and parallel to said opposing sides of said channel, wherein said nut includes a central pillar and a plurality of flanges extending radially from said central pillar to present said contact surfaces, said bore extending into said central pillar, wherein said nut includes an elongated platform slideably engaging said channel for limiting rotation of said nut in said channel, said pillar and said flanges integral with and extending upwardly from said platform whereby the height of said rail relative to said base is adjusted in response to rotation of said threaded fastener in said bore in said pillar and said elongated platform limits rotation of said nut.

15. An assembly as set forth in claim 14 wherein said opposing sides of said channel include a first side and a second side opposing said first side and said flanges on said nut include a first flange and a second flange presenting said contact surfaces parallel to said first side and a third flange and a fourth flange presenting said contact surfaces parallel to said second side.

16. An assembly as set forth in claim 15 wherein said first flange extends at a side angle relative to said second flange and said third flange extends at said side angle relative to said fourth flange.

17. An assembly as set forth in claim 16 wherein said first flange extends at an end angle relative to said fourth flange and said second flange extends at said end angle relative to said third flange.

18. An assembly as set forth in claim 17 wherein said side angle is greater than said end angle with said side angle and said end angle being supplementary.

19. An assembly as set forth in claim 18 wherein said central pillar is further defined as being round and said first flange and said second flange and said third flange and said fourth flange extend radially at an equal length from said central pillar.

* * * * *